US005168943A

United States Patent [19]

Falgout, Sr.

[11] Patent Number: 5,168,943

[45] Date of Patent: Dec. 8, 1992

[54] ADJUSTABLE BENT SUB

[76] Inventor: Thomas E. Falgout, Sr., 110 Bellaire Rd., Lafayette, La. 70503

[21] Appl. No.: 719,357

[22] Filed: Jun. 24, 1991

[51] Int. Cl.[5] ..... E21B 7/08

[52] U.S. Cl. ..... 175/74; 175/256; 285/397

[58] Field of Search ..... 175/74, 61, 73, 75, 175/256, 320; 285/370, 397, 53, 333

[56] References Cited

U.S. PATENT DOCUMENTS

| | | | |
|---|---|---|---|
| 2,259,191 | 10/1941 | Allen | 285/397 X |
| 2,699,182 | 1/1955 | Baldridge, Jr. | 285/397 X |
| 4,813,497 | 3/1989 | Wenzel | 175/74 |
| 5,029,654 | 7/1991 | Wilson et al. | 175/256 X |
| 5,094,305 | 3/1992 | Wenzel | 175/75 X |

*Primary Examiner*—Terry Lee Melius
*Attorney, Agent, or Firm*—John D. Jeter

[57] ABSTRACT

The sub, usable as a length element of a drill string which may include a drilling motor body, comprises three generally tubular members. Two members, each having means to attach to a continuing drill string, have threaded boxes positioned in opposition. A third member is a double ended threaded, shoulderless, pin threadedly extending into the boxes with box faces in contact when the sub is assembled. One box, and the mating pin end, have threads coarser than the finer threads in the other box and on it's mating pin end. Axial position adjustment of the pin causes the abutting box faces to change rotational relationship, thus changing the rotational relationship of axially spaced drill string elements separated by the sub. If the sub is to be used to deflect the drill string centerline, the double ended pin and the threaded boxes have a centerline tilted a small angle from the centerline of the first two members. In one configuration the assembly has, preferably, both end centerlines on one line. Manipulation as previously described rotates one end of the sub relative to the other end to cause the overall centerline of the assembly to be deflected.

16 Claims, 2 Drawing Sheets

ADJUSTABLE BENT SUB

This invention pertains to adjustable drill string connections usable to change the orientation of a lower portion relative to an upper portion of the drill string. The most immediate use of the invention will be in a drilling motor body to deflect the lower motor centerline. The motor is considered part of the drill string into which it is installed.

BACKGROUND OF THE INVENTION

Directional drilling is a well established art in the well drilling industry. Various elements are available for inclusion in the drill string to influence the course of the well bore as drilling progresses. Apparatus for use downhole to indicate at the surface various parameters measured downhole are now in common use and generally known as Measurement While Drilling or MWD arrangements. At the present time the drill string often has to be oriented rotationally relative to earth to measure and influence the course of the well bore as it is further drilled.

Frequent measurements and corrections now practical demand only small amounts of bend in drill strings to deflect the drill string centerline to make well bore corrections. It is practical to rotate the drill string with such slight bends to drill ahead along the existing centerline. There are two salient problems in making up the downhole assembly to drill with bent elements, commonly known as bent subs, whatever their length. The first problem pertains to rotational alignment of drill string components separated by threaded connections. The second problem pertains to adjustably bending the bent sub to deflect the centerline of the lower portion of the string relative to the upper portion. Apparatus of this invention addresses those two problems.

It is therefore an object of this invention to provide an adjustable sub to change the rotational orientation of axially spaced portions of a drill string.

It is another object of this invention to provide an adjustable sub to deflect the centerline of a drill string.

It is yet another object of this invention to provide adjustable subs that require no shims and may complete the adjustment by the application of torque in the manner used on tool joints, with the same tongs.

It is still a further object of this invention to provide adjustable subs for use in drilling motor housings to change the orientation of the lower end relative to the upper end of the bodies.

These and other features and advantages will be apparent to those skilled in the art from consideration of the included claims and appended drawings.

SUMMARY OF THE INVENTION

The alignment sub is provided in two forms, a rotational alignment sub and a deflection sub. Common features will be described first.

There are three essential tubular members, two members each have straight threaded bores, or boxes, on one end, each box facing the other. One box has coarser threads than the other. A third member is a double ended shoulderless pin extending threadedly into each box to form a generally elongated tubular assembly with opposite ends of the pin threadedly mating the threads in the related box. Opposite ends of the assembly, or sub, are arranged to attach to the extending portions of the drill string of which the sub is an element. If the sub is part of a drilling motor body, one end may be the lower portion that carries the output shaft. The output shaft, in that case, usually extends through the bore of the third member to a torque producing rotor above the sub.

The faces on the boxes are threadedly drawn together in the usual tool joint tightening process to make the assembly rigid and usable in the drill string. When assembled, the pin can be unscrewed from the coarser threaded box to leave a gap between the two faces. The finer threaded box can then be screwed further onto the pin to bring the two faces together again. More rotation is required of the finer threads with the result that radial lines in each of the boxes, if originally coincident, will be rotationally displaced. This changes the rotational relationship of one box relative to the other and, hence, changes the rotational relationship of axially spaced portions of the drill string containing the apparatus of this invention. To make changes in the opposite direction, the finer thread is first unscrewed to space the box faces.

The rotational alignment sub accomplishes the intended purpose by relative rotation of opposite ends of the sub as described above. The deflection sub differs in that the double ended pin, and the associated boxes are on a centerline that crosses the axis of the centerline of the drill string at a small angle. The preferred construction has the pin centerline crossing the centerline of the end attached to the upwardly continuing drill string at a point coinciding with the plane of the two box faces which is perpendicular to the pin centerline. Also preferred is construction which permits one configuration to place centerlines of opposite ends of the sub on one line, a straight configuration. Rotation of one end, relative to the other, one half turn then yields a total axis deflection of twice the amount of angle of the pin centerline relative to the straight configuration centerline.

To deflect the centerlines of opposite ends of the sub the same process described for changing the rotational relationship is used. Unscrewing the coarse end of the pin as before and retightening the finer threaded box results in a change in the rotational relationship between the box .containing members. The changed rotational relationship between ends containing the deflected box centerline results in changing the angle of the extended centerline of one box containing member relative to the extended centerline of the other. That action results in change in the deflection of axially spaced portions of the drill string containing the deflection adjusting sub.

When the apparatus is used in a drilling motor body the radial walls of all members may be thinner than those used up-string. The bores in the members may be larger to accomodate a motor driveshaft.

To assure that the pin turns on the preferred end relative to mating box threads set screws are optionally installed radially in the walls of each box containing member to be selectively tightened against the pin to rotationally secure the pin to a box. After tightening up the assembly for use, the screws can all be tightened.

The rotational alignment and deflection subs can be, and usually will be, used in series by merely screwing them together in making up the downhole assembly. They can, however, be combined in one assembly of five principal components. One end of the rotational alignment sub and one end of the deflection sub is combined to form a tubular center member having a coaxial threaded box on one end and threaded box on the other end that has an axis deflected from the axis of the coaxial box. A tool joint connection is saved by this process.

When adjusting the deflection sub one end is rotated relative to the other an amount proportional to the amount of deflection intended for the centerline. That rotation may require correction of the rotational alignment between selected radial lines axially spaced along the drill string assembly. The rotational alignment sub is usable to do this correcting by processes previously described herein.

At the juncture of the box faces for both forms of the sub at least one index line is needed and is usually inscribed in the outer surface. One box may have scribe lines distributed about the periphery to indicate the amount of rotation of one box relative to the index of the other. Such lines may wear away in time. A self adhesive, temporary, decal has been devised to stick on at least one box periphery to serve the same purpose. For the rotational alignment sub, the decal is marked in degrees. For the deflection sub, the decal is marked with the amount of deflection produced by rotation of one box relative to the other. The decals have an index line that is aligned with the deeply inscribed index line for the related box. The decals wear away rather quickly but are readily replaced when adjustments are to be made.

BRIEF DESCRIPTION OF DRAWINGS

In the drawings wherein like captions refer to like features.

DETAILED DESCRIPTION OF DRAWINGS

The sub of this invention is to be assembled into a drill string and to serve as a length thereof. A drill string is construed to include everything below the swivel, including the drill head, or bit. The sub has a bore through which drilling fluid will flow. Other bore conducted elements may also pass through the sub bore, such as wire lines, motor driveshafts and Measurement While Drilling (MWD) apparatus and the like. An optional use of the sub is to be part of a drilling motor body and to adjustably bend that body. In all cases, opposite ends of the drill string extend from opposite ends of the orienting sub.

Figure 1:
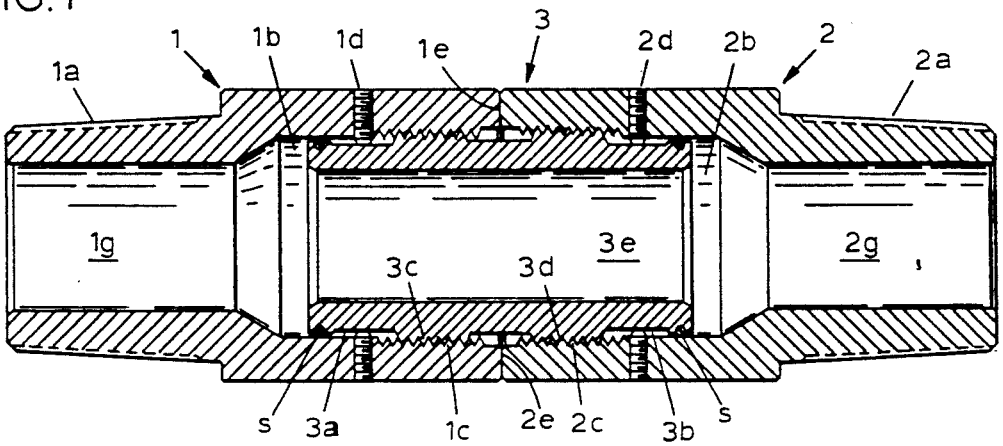
FIG. 1 is a cutaway of a rotational orienting sub and the simplest form of the invention.

In FIG. 1 a rotational orienting sub is assembled and ready for field use. The axis of members 1, 2, and 3 are on the same line. Member 1 has means on the left end, a tool joint pin 1*a*, to connect to the upwardly continuing drill string. Member 1 has bore 1*b* with straight threads 1*c*, and face 1*e*. The box differs from a tool joint box in that it has straight threads. Member 2 is identical to member 1 with the exception that threads 1*c* have twice the pitch as threads 2*c*, and pin 2*a* to attach to a downwardly continuing portion of the drill string. Double pitch threads 1*c* is a matter of choice because the threads must only differ in pitch to function, in principle, as described herein.

Figure 2:
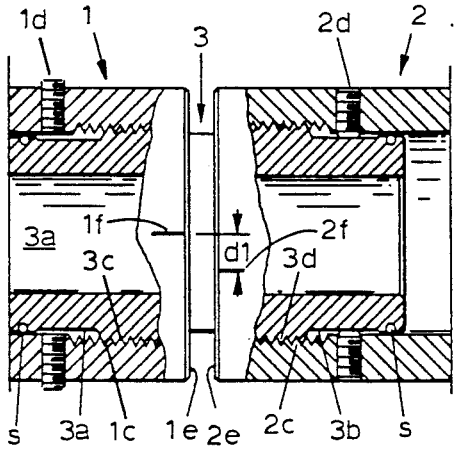
FIG. 2 is an elevation of the sub of FIG. 1, mostly cut away, showing only the central portion after some adjustment steps have been taken.

Member 3 is a double ended, threaded and shoulderless, tool joint pin. The threads 3*c* and 3*d* match the threads 1*c* and 2*c* respectively. Set screws 1*d* and 2*d* can be selectively tightened on surfaces 3*a* and 3*b* respectively to cause the pin to turn in the selected box when the two ends of the sub are separated as shown in FIG. 2 for adjustment. Anything that normally passes along the drill string bore can pass through bores 1*g*, 3*e*, and 2*g*. Seals marked s protect set screws if they are not independently sealed.

Preferred construction of the sub provides juxtaposed index lines on the box peripheries when the pin 3 is centered in the torqued up boxes. In FIG. 2, set screws 2*d* have been tightened on surface 3*a*, set screws 1*d* have been loosened to clear surface 3*b*, and pin 3 has been unscrewed from the box of member 1. Index lines 1*f* and 2*f* are peripherally separated an amount d1 and faces 1*e* and 2*e* are separated as shown by action of the double pitch threads.

Figure 3:
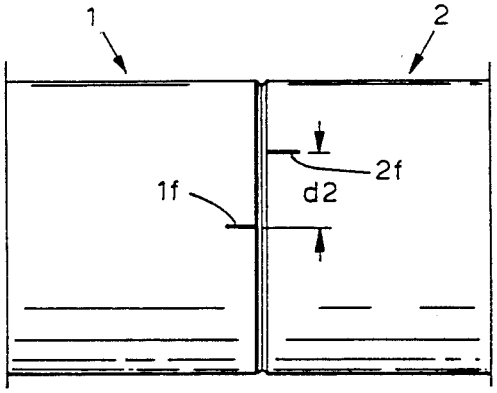
FIG. 3 is an elevation of the sub of FIG. 2 after adjustment is made.

FIG. 3 shows the sub after set screws 1*d* are tightened, set screws 2*d* are loosened, and member 2 is tightened up on the single pitch threads 2*c* and 3*d*. The finer threads require more rotation of member 2 to bring the faces 1*e* and 2*e* into contact and the index lines 1*f* and 2*f* are now separated by peripheral distance d2. The distance d2 expressed in angular degrees represents the amount the adjustment just described has changed the rotational relationship between opposite ends of the sub, and, hence, between opposite ends of the drill string into which the sub is assembled.

If the single and dual pitch combination is used the thread forms can be identical. The coarse thread is loosened half as much as the final desired rotational change. In the case of 4 pitch threads, a full circle reorientation is possible in only one-fourth inch change in axial position of the pin within the boxes. A marker is normally used on member 3 to show when it is axially displaced from the neutral position. Further adjustment processes may be altered to bring member 3 toward neutral axial position.

Figure 4:
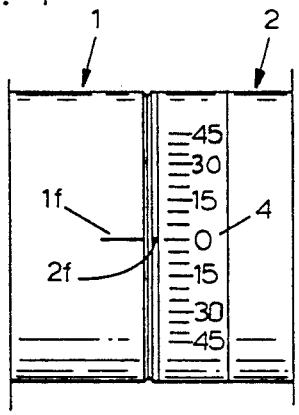
FIG. 4 is an elevation of the center portion of the sub of FIGS. 1 and 3 showing an optional adjustment aiding accessory.

In FIG. 4 a stick-on decal is shown as normally applied while adjusting the rotation orienting sub. The zero line is shown aligned with index line 2*f*. When index line 1*f* is moved, the amount of movement is shown opposite line 1*f*. The decal quickly wears away, leaving a clean surface for the next decal when adjustment is to be made.

Figure 5:
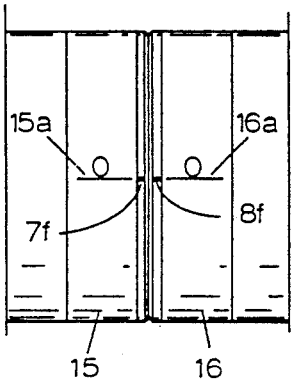
FIG. 5 is an elevation similar to FIG. 4 but more appropriate for use on the subs of FIGS. 6 and 8.

FIG. 5 will be more easily explained after the axis deflection sub is described.

Figure 6:
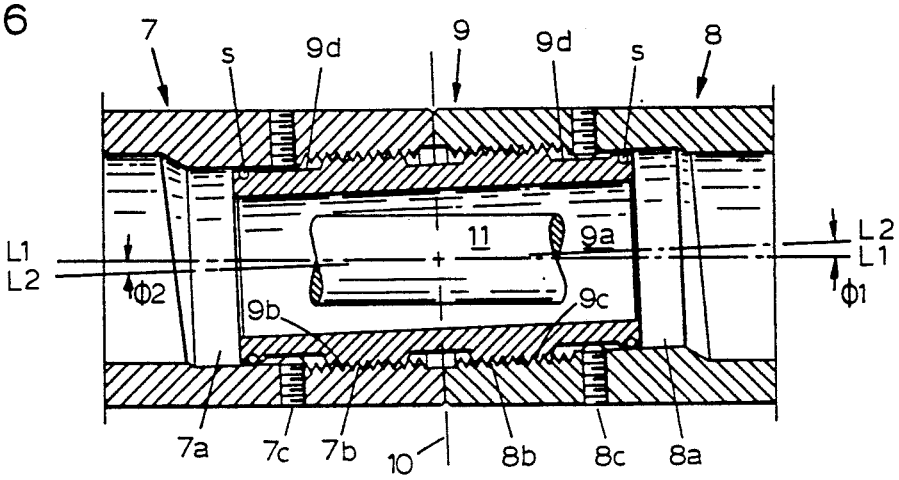
FIG. 6 is a sectional view of an axis deflection adjustment sub in the straight configuration.

FIG. 6 represents an axis deflecting sub that could be constructed exactly like the sub of FIG. 1 except for the angular relationship between the centerline L2 of the double ended pin and the line L1 which, in this instance, contains the centerlines of both members 7 and 9. The angles $\phi$1 and $\phi$2 are normally both one and one-half degrees. It is two degrees here for graphic clarity. Preferred construction features that aid in design, fabrication, and use but by no means comprise limitations includes the condition that plane 10, containing both faces in contact of boxes of members 7 and 8 be perpendicular to line L2 and be coincident with the intersection of lines L1 and L2. Angles $\phi$1 and $\phi$2 are identical. Members 7 and 8 are identical excepting that threads 7*b* are double threads and threads 8*b* are single pitch, preferably all of the same thread form. Small departures from these conditions cause almost undetectable operational differences and even large differences in the above stated geometric relationships may leave the operational principle intact. This is considered by and is within the scope of the claims.

With the adjustment state shown the axes of the members 7 and 8 lie on the same line, the pin 9 is axially centered and index scribe lines (not shown) on the outer periphery near plane 10 are coincident.

Consider set screws 7*c* loosened and 8*c* tightened. Rotation of member 8 will rotate pin 9 about L2. The right end of L1 will rotate about the right end of L2, describing the surface of a cone, while the left ends of L1 and L2 remain stationary. After this first deflection action, the faces of the boxes will be separated as shown in FIG. 2. Member 7 must now be rotated to compress the faces in preparation for torqueing up for use. Now both members have been rotated about the pin axis. At each end line L1 will have generated some imaginary surface of a cone about L2. Only the rotational relationship between opposite ends of the sub need be considered to determine the resulting angle of end-to-end deflection of L1. The line L1 becomes bent or deflected at plane 10 up to a maximum angle of twice $\phi 1$, at 180 degrees of rotation between sub ends. The rotation of the opposite ends and control of pin 9 can be carried out as previously described for FIGS. 1, 2, and 3. This drawing is the configuration intended for use in drilling motor bodies to bend the body between the power producing rotor and the support bearings for the output drive shaft. The support bearings represent the means to attach to the downwardly continuing portion of the drill string for this construction. The rotor and the drill head driving shaft are connected by shaft component 11 which passes through bore 9*a*. The seals marked s are needed to protect the set screws if they are not independently sealed. Bores 7*a* and 8*a* are on the same extended axis. Mating threads 9*b* and 7*b* differ in pitch from mating threads 8*b* and 9*c*. Surfaces 9*d* are for set screw grip as previously described.

Figure 7:
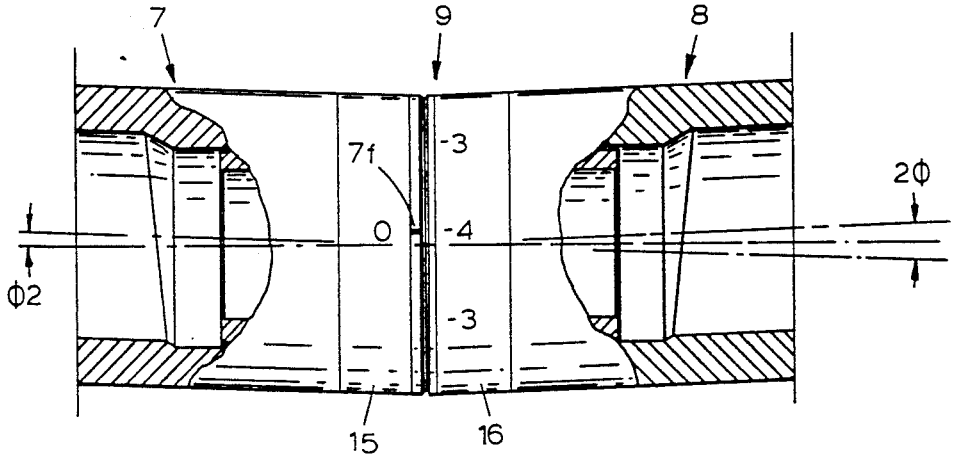
FIG. 7 is an elevation, partly cut away, of the sub of FIG. 6 after adjustment for maximum deflection.

FIG. 7 shows the sub after maximum deflection and retightening for service. Stick-on decals are shown in place. Index line 7*f* indicates four degrees deflection. Index line 8*f* is out of sight, one-half turn away, on the far side and will indicate 180 degrees on decal 16. Some operators prefer engraving the markings shown on the decals directly into the periphery of the sub. That poses no problem if wear rate is acceptable. Either of the index lines can be located in relation to some other feature of the downhole assembly whether on decals or engraved in the sub. The example cited above illustrates relationships and their changes that result from manipulation of sub members and no limitation is intended.

Figure 8:
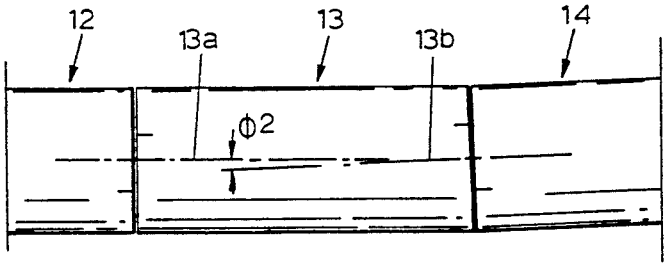
FIG. 8 is an elevation of a combination sub having features of the subs of both FIG. 1 and FIG. 6.

FIG. 8 is a special form of combination sub having both rotational alignment and axis deflection capabilities. The juncture between members 12 and 13 compares with that of FIG. 1. The juncture between members 13 and 14 compares with that of FIG. 6. Otherwise stated, the left end has a pin axis coincident with the box axes for rotational alignment and the right end has the pin axis crossing the axis of member 13 for axis deflection adjustment. Member 12 may be identical to member 1 of FIG. 1. Member 14 may be identical to member 8 of FIG. 6. The left end of member 13 has the box of FIG. 1, and the right end has the box of member 7 of FIG. 6. Fewer members are needed to replace two orienting subs.

In use, the FIG. 8 arrangement permits the rotational misalignment caused by adjusting for axial deflection to be directly noted on the scales, such as shown in FIG. 7, on member 13 for use directly in correcting the rotational alignment at the member 12-member 13 juncture as previously described herein.

FIG. 5 can now be described with reference to FIG. 7. FIG. 5 shows some surface of the sub of FIG. 6. In FIG. 5 the sub is straight and index lines 7*f* and 8*f* are coincident. Index lines 15*a* and 16*a* are applied to also be coincident. Steps taken to change the rotational relationship between opposite ends of the sub have been defined. Quantification markings about the periphery of decal 15 will be the degrees, relative to index 16*a*, that a plane containing both ends of the bent line L1 will be rotated relative to index 15*a*. Quantification markings on decal 16 will be in degrees up to a maximum of twice $\phi 1$, four degrees total in this case in reference to the index line 15*a*. Preferred markings on decal 15 is zero to 180 degrees in both peripheral directions. Preferred markings for decal 16 is zero to maximum deflection in both directions with clockwise and counterclockwise indicators.

A simplified system for the decals provides an index line that is placed on the outer periphery where a plane containing lines L1 and L2, for each end, intersects plane 10 at the most obtuse angle. In the oil field that point is called the "short side". The decals are marked 0 to 4 on one and 0' to 4' on the other. Only 180 degrees are marked, the other 180 degrees unmarked. To deflect the axis 3 degrees, for instance, the opposite ends are manipulated until the 3 and 3' are superimposed. This point is the tool face or lies on the plane that contains the axis of both ends of the sub.

Descriptive matter used herein has include arrangements of planes and lines. Some of these are preferences, not limitations. Salient points of novelty for the rotational alignment sub comprises threads of different pitches, as described, on adjustment members. For the deflection sub the axes of the adjustment threads are not parallel to the general centerline of the drill string in the least deflected state.

From the foregoing, it will be seen that this invention is one well adapted to attain all of the ends and objects hereinabove set forth, together with other advantages which are obvious and which are inherent to the methods and apparatus.

It will be understood that certain features and sub combinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. An orienting sub for use as a length element in a drill string to adjustably change the relative orientation between axially spaced portions of the drill string, the sub comprising:

a) a first member having an axis, means at a first end for fluid tight attachment to a drill string, a bore generally along said axis and a tool joint box at a second end having straight threads and a first transverse plane face;

b) a second member having an axis, means at a first end for fluid tight attachment to a drill string, a bore generally along said axis and a tool joint box at a second end having straight threads and a second transverse plane face;

c) a third generally tubular member having an axis, a bore generally along said axis, threads of a first pitch on a first end to threadedly engage said threads in the box of said first member and threads of a different pitch on the other end to threadedly engage said threads on said box of said second member;

d) a thread relationship among said three members such that a preselected rotational relationship exists between said first two members when said transverse plane faces are in mutual engagement and a preselected point on said third member is on said transverse plane, whereby adjustably changing the axial position of said point relative to said plane a preselected amount changes the rotational relationship between said first two members a preselected amount.

2. The sub of claim 1 wherein the axis of said third member is generally coaxial with said axes in said boxes to result in rotational change in the orientation between said first and second members without deflecting the overall centerline of the sub.

3. The sub of claim 1 wherein said axis of said third member is not parallel to the axes of said first and second members so that axial position change of said third member results in change of the rotational relationship between said second and third members and a consequent deflection of said axes of said first and second members.

4. The sub of claim 1 wherein set screws are provided in at least one of said first and second members arranged to releasably secure said third member rotationally to one of said other members.

5. The sub of claim 3 wherein the axis of the box of each first and second member crosses the axis of the member containing the box at a point coincident with a plane defining the surfaces of said faces of the boxes, said plane being perpendicular to the axis of the third member.

6. The sub of claim 1 said threads differ in pitch such that the coarser thread is a double thread, and the finer thread is a single thread.

7. An orienting sub for use as a length element of a drill string, comprising: a body having at least three generally tubular members, a generally central axis, first and second ends, a drilling fluid channel extending axially through the sub, and means at each end to attach to a continuing drill string, all three said members having threads distributed about said axis, a first thread in a first member arranged to threadedly engage mating second threads on a second member, said second member having third threads arranged to threadedly engage fourth threads on a third member, said first and said third members having opposed abutments having surfaces describing a plane that is perpendicular to the centerline of said second thread, said second and third threads having different pitch such that when said abutments are in mutual engagement and a point on said second member lies in said plane a preselected rotational relationship exists between said first and third members and when said point is adjustably moved axially a preselected amount, said abutments in engagement, the rotational relationship between said first and third members changes a preselected amount.

8. The sub of claim 7 wherein the centerline of said threads are on a line that crosses said axis in the vicinity of said plane such that changing said rotational relationship between said first and said third members also deflects said axis at said plane an amount proportional to the amount of rotation of said third member relative to said first member up to an amount of deflection twice the angle between said centerline and said axis before deflection.

9. The sub of claim 8 wherein said first member is an upper portion of the body of a drilling motor and said third member is a lower portion of a drilling motor body that contains the motor output drive shaft support bearings which serve as means to attach to the downwardly continuing portion of the drill string.

10. The sub of claim 7 wherein said second member comprises a double ended straight threaded and shoulderless tool joint pin arranged to threadedly engage tool joint boxes in said first and third members which have box faces to serve as said abutments and to compress said faces together on application of tightening torque between said first and said third members.

11. The sub of claim 8 wherein said second member comprises a double ended straight threaded and shoulderless tool joint pin arranged to threadedly engage tool joint boxes in said first and third members which have box faces to serve as said abutments and to compress said faces together on application of tightening torque between said first and said third members.

12. The sub of claim 7 wherein at least one of said members has releasable means to temporarily secure at least one of said first and said third members rotationally to said second member.

13. The sub of claim 12 wherein said releasable means comprises at least one set screw arranged to extend through the wall of at least one box to releasably and selectively secure said second member rotationally to said first or third member.

14. The sub of claim 13 wherein at least one set screw is provided to extend through the wall of each of said boxes to releasably and selectively secure said second member rotationally to said first or third member.

15. The sub of claim 7 wherein said first and fourth threads differ in that one thread is a double thread and the other thread is a single thread.

16. The sub of claim 7 wherein said second member is sealingly situated in said other members to prevent exposure of said threads to fluid pressure in the drill string bore.

* * * * *